US011143065B2

(12) United States Patent
Choi et al.

(10) Patent No.: US 11,143,065 B2
(45) Date of Patent: Oct. 12, 2021

(54) ELECTRO-MECHANICAL VARIABLE VALVE MECHANISM, CONTROL UNIT FOR VARIABLE VALVE MECHANISM, ELECTRO-MECHANICAL VARIABLE VALVE SYSTEM AND CONTROL METHOD THEREOF

(71) Applicants: Hyundai Motor Company, Seoul (KR); Kia Motors Corporation, Seoul (KR); You-Seok Back, Suwon-si (KR)

(72) Inventors: Myung-Sik Choi, Seoul (KR); You-Seok Back, Suwon-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 97 days.

(21) Appl. No.: 16/682,720

(22) Filed: Nov. 13, 2019

(65) Prior Publication Data

US 2020/0157981 A1 May 21, 2020

(30) Foreign Application Priority Data

Nov. 20, 2018 (KR) ..... 10-2018-0143638

(51) Int. Cl.
*F01L 13/00* (2006.01)
*F01L 7/02* (2006.01)
*F02D 13/02* (2006.01)

(52) U.S. Cl.
CPC ..... *F01L 13/0042* (2013.01); *F01L 7/02* (2013.01); *F02D 13/0226* (2013.01)

(58) Field of Classification Search
CPC .. F02D 13/0226; F02D 13/0223; F02D 13/02; F02D 13/00; F01L 7/02; F01L 7/00; F01L 13/0042; F01L 13/0005; F01L 13/0015; F01L 13/0036; F01L 2013/001; F01L 2013/0052
USPC ..... 123/90.15–90.18
See application file for complete search history.

(56) References Cited

U.S. PATENT DOCUMENTS

| | | | | |
|---|---|---|---|---|
| 2016/0208661 | A1* | 7/2016 | Tomoda | F01L 1/08 |
| 2018/0363518 | A1* | 12/2018 | Raimondi | F01L 13/0036 |
| 2020/0131947 | A1* | 4/2020 | Cecur | F01L 1/182 |
| 2020/0131948 | A1* | 4/2020 | Cecur | F01L 1/267 |
| 2020/0131949 | A1* | 4/2020 | Cecur | F01L 1/185 |
| 2020/0131953 | A1* | 4/2020 | Cecur | F01L 1/185 |
| 2020/0271024 | A1* | 8/2020 | Stretch | F01L 1/181 |

FOREIGN PATENT DOCUMENTS

| | | | | |
|---|---|---|---|---|
| KR | 20090121692 A | 11/2009 | | |
| WO | WO-2017144706 A1 * | 8/2017 | | F01L 1/185 |
| WO | WO-2018162094 A1 * | 9/2018 | | F01L 1/047 |

* cited by examiner

*Primary Examiner* — Devon C Kramer
*Assistant Examiner* — Kelsey L Stanek
(74) *Attorney, Agent, or Firm* — Slater Matsil, LLP

(57) ABSTRACT

An electro-mechanical variable valve mechanism includes a variable valve mechanism body, a latching pin arranged in front of the variable valve mechanism body, and an inner body arranged inside the variable valve mechanism body. The latching pin reciprocates in a longitudinal direction of the variable valve mechanism body and the inner body to latch the variable valve mechanism body and the inner body.

20 Claims, 9 Drawing Sheets

ELECTRO-MECHANICAL VARIABLE VALVE MECHANISM, CONTROL UNIT FOR VARIABLE VALVE MECHANISM, ELECTRO-MECHANICAL VARIABLE VALVE SYSTEM AND CONTROL METHOD THEREOF

CROSS-REFERENCE TO RELATED APPLICATIONS

This application claims priority to Korean Patent Application No. 10-2018-0143638, filed on Nov. 20, 2018, which application is hereby incorporated herein by reference.

TECHNICAL FIELD

Exemplary embodiments of the present disclosure relate to an electro-mechanical variable valve mechanism, a control unit for the variable valve mechanism, an electro-mechanical variable valve system and a control method thereof.

BACKGROUND

Generally, an internal combustion engine generates power by receiving fuel and air into a combustion chamber and burning the fuel. When the air is sucked, intake valves are operated by means of driving of a camshaft and air is sucked into the combustion chamber while the intake valves are opened.

Moreover, exhaust valves are operated by means of driving of the camshaft and exhaust is discharged from the combustion chamber to the outside while the exhaust valves are opened.

Current representative technologies for improving efficiency of a gasoline engine include a variable valve timing (VVT) and variable valve lift (VVL) technology that can control a valve overlap period by adjusting opening and closing timings at which valves are opened and closed and height of lift of valves. Using this technology makes it possible not only to improve output of an engine but also to reduce nitrogen oxides by an internal exhaust gas recirculation (EGR) and improve fuel efficiency due to reduction of pumping loss.

A latching mechanism in a structure of lifting a variable valve inter alia serves as a mechanical switch for converting a high-speed cam and a low-speed cam of a valve train. Generally, the latching mechanism in the structure of lifting the variable valve is required to be capable of being converted at an appropriate oil pressure and being changed within one to three cycles of an engine and satisfying specific durability at the maximum rotation speed set for the low-speed cam and high-speed cam respectively. In addition, the latching mechanism is required to be manufactured easily and not to generate excessive shock during latching. Further, the latch mechanism is required to control lost motion due to rotation of the high-speed cam.

However, in the conventional variable valve mechanism, there is a problem in that since hydraulic pressure is used for on/off control of a latching pin, the hydraulic pressure influences and is influenced by pressure of engine oil and thus the degree of freedom of the control is low so that the variable valve mechanism is inefficient.

Further, since the conventional variable valve mechanism is composed of a plurality of components, there is another problem in that its structure is complicated and the production cost rises.

SUMMARY

Exemplary embodiments of the present disclosure relate to an electro-mechanical variable valve mechanism, a control unit for the variable valve mechanism, an electro-mechanical variable valve system and a control method thereof. Particular embodiments relate to an electro-mechanical variable valve mechanism, a control unit for the variable valve mechanism, an electro-mechanical variable valve system and a control method thereof, which are configured to control the variable valve mechanism electro-mechanically.

Embodiments of the invention can overcome problems of the prior art to provide an electro-mechanical variable valve mechanism, a control unit for the variable valve mechanism, an electro-mechanical variable valve system and a control method thereof, which are configured to control the variable valve mechanism electro-mechanically so that optimum control of valves is performed with fewer components.

Other advantages of the present disclosure can be understood by the following description and become apparent with reference to the embodiments of the present disclosure. Also, it is obvious to those skilled in the art to which the present disclosure pertains that the objects and advantages of the present disclosure can be realized by the means as claimed and combinations thereof.

In accordance with aspect of the present disclosure, an electro-mechanical variable valve mechanism comprises a variable valve mechanism body and a latching pin arranged in front of the variable valve mechanism body. An inner body is arranged inside the variable valve mechanism body. The latching pin reciprocates in the longitudinal direction of the variable valve mechanism body and the inner body to latch the variable valve mechanism body and the inner body.

A latching pin reciprocating part for allowing the latching pin to reciprocate may be formed in front of the variable valve mechanism body.

A latching spring for imparting spring force to the latching pin may be provided in front of the variable valve mechanism body.

A latching part at which the latching pin is to be latched may be formed in front of the inner body.

Length of the latching pin may be configured to be larger than length of the latching pin reciprocating part of the variable valve mechanism body.

An end of the latching pin at which the latching pin is latched to the inner body may be of a plane.

A portion of the latching pin at which the latching pin contacts a control unit for the variable valve mechanism may be of a round shape.

In accordance with another aspect of the present disclosure, a control unit for a variable valve mechanism comprises a control camshaft, a control cam through which the control camshaft passes, a control camshaft connection pin arranged inside the control cam and connected to the control camshaft, and a control spring to be pressed to the control camshaft connection pin.

The control cam may be of a fan shape.

The control cam may be configured such that a control cam hole for allowing the control camshaft connection pin and the control spring to be arranged therein is formed to pierce the control cam.

In accordance with still another aspect of the present disclosure, an electro-mechanical variable valve system comprises an electro-mechanical variable valve mechanism including a variable valve mechanism body. A latching pin is arranged in front of the variable valve mechanism body and an inner body is arranged inside the variable valve mechanism body. A control unit for the variable valve mechanism includes a control camshaft, a control cam through which the control camshaft passes, a control camshaft connection pin arranged inside the control cam and connected to the control camshaft, and a control spring to be pressed to the control camshaft connection pin. The control unit for the variable valve mechanism reciprocates the latching pin of the electro-mechanical variable valve mechanism to latch or unlatch the variable valve mechanism body and the inner body.

The control unit for the variable valve mechanism may press the latching pin to latch the variable valve mechanism body and the inner body of the electro-mechanical variable valve mechanism.

The control unit for the variable valve mechanism may release pressure to the latching pin to unlatch the variable valve mechanism body and the inner body.

In according to yet another aspect of the present disclosure, a control method of an electro-mechanical variable valve system comprises mounting an electro-mechanical variable valve mechanism and a control unit for the variable valve mechanism, pressing a latching pin of the electro-mechanical variable valve mechanism by a control cam of the control unit for the variable valve mechanism, and releasing pressure to the latching pin of the electro-mechanical variable valve mechanism by the control cam of the control unit for the variable valve mechanism.

Upon pressing the electro-mechanical variable valve mechanism by the control cam of the control unit for the variable valve mechanism, the latching pin can be converted from an unlatched state to a latched state.

Upon being converted from the unlatched state to the latched state, the latching pin can be latched at the time when the control cam is in a base circle and the center of a latching hole of an inner body is concentric with the center of the latching pin.

Upon being converted from the unlatched state to the latched state, a control spring is compressed at the time when the control cam is lifted, and the latching pin can be latched at the time when the control cam is in a base circle section.

Upon releasing pressure to the electro-mechanical variable valve mechanism by the control cam of the control unit for the variable valve mechanism, the latching pin can be converted from the latched state to the unlatched state.

The latching pin can be unlatched at the time when the control cam is in the base circle and the center of the latching hole of the inner body is concentric with the center of the latching pin.

When the control cam comes in the base circle section from a lifting section, the inner body releases pressure to the latching pin so that the latching pin can be unlatched by the latching spring.

According to an embodiment of the present disclosure, the electro-mechanical variable valve mechanism, the control unit for the variable valve mechanism, the electro-mechanical variable valve system and the control method thereof provide advantageous effects in that it is possible to control the variable valve mechanism electromechanically so that it is possible to control the variable valve mechanism irrespective of the state of engine oil. It is possible to lower production cost because they are composed of fewer components. It is also possible to improve fuel efficiency and torque because they make it possible to perform optimal control of valves.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The above and other objects, features and other advantages of the present disclosure will be more clearly understood from the following detailed description taken in conjunction with the accompanying drawings, in which.

DETAILED DESCRIPTION OF ILLUSTRATIVE EMBODIMENTS

Embodiments described below are provided in order for those skilled in the art to easily understand the technical spirit of the present disclosure and the present disclosure is not limited thereto. In addition, contents represented in the accompanying drawings are diagrammed in order to easily describe the embodiments of the present disclosure and may be different from configurations actually implemented.

It is to be understood that when a component is referred to as being coupled or connected to the other component, it may be directly coupled or connected to the other component but there may be another component interposed therebetween.

The term "connection" as used herein includes direct connection and indirect connection between a member and another member and may mean all physical connections such as adhesion, attachment, fastening, bonding and coupling.

In addition, the expressions such as "first," "second," etc. are used only to distinguish a plurality of components but not limit the order of the components or other features.

Singular expressions include plural expressions unless the context clearly indicates otherwise. The term "comprising" or "having" is intended to mean that there are features, numbers, steps, operations, components, parts, or combinations thereof described in the specification, and it may be interpreted that one or more other features, numbers, steps, operations, components, parts, or combinations thereof may be added thereto.

Figure 1:
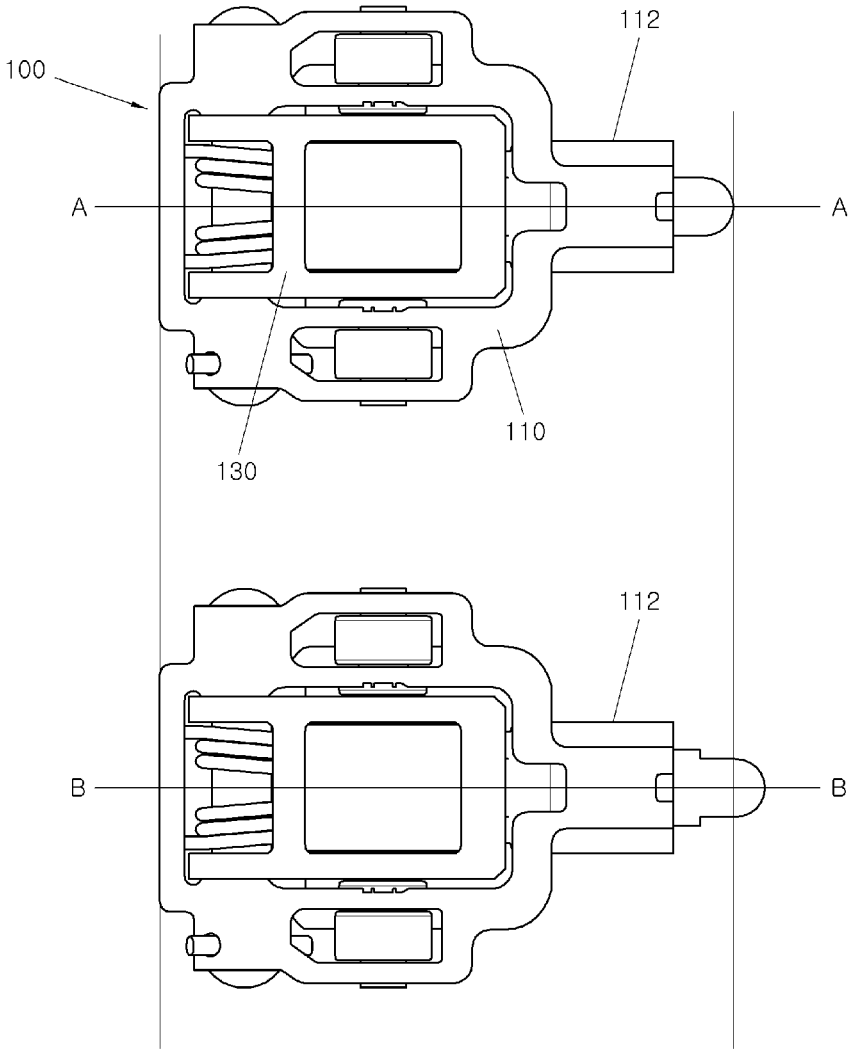
FIG. 1 is a schematic plane diagram of a variable valve mechanism according to an embodiment of the present disclosure.
Figure 2:
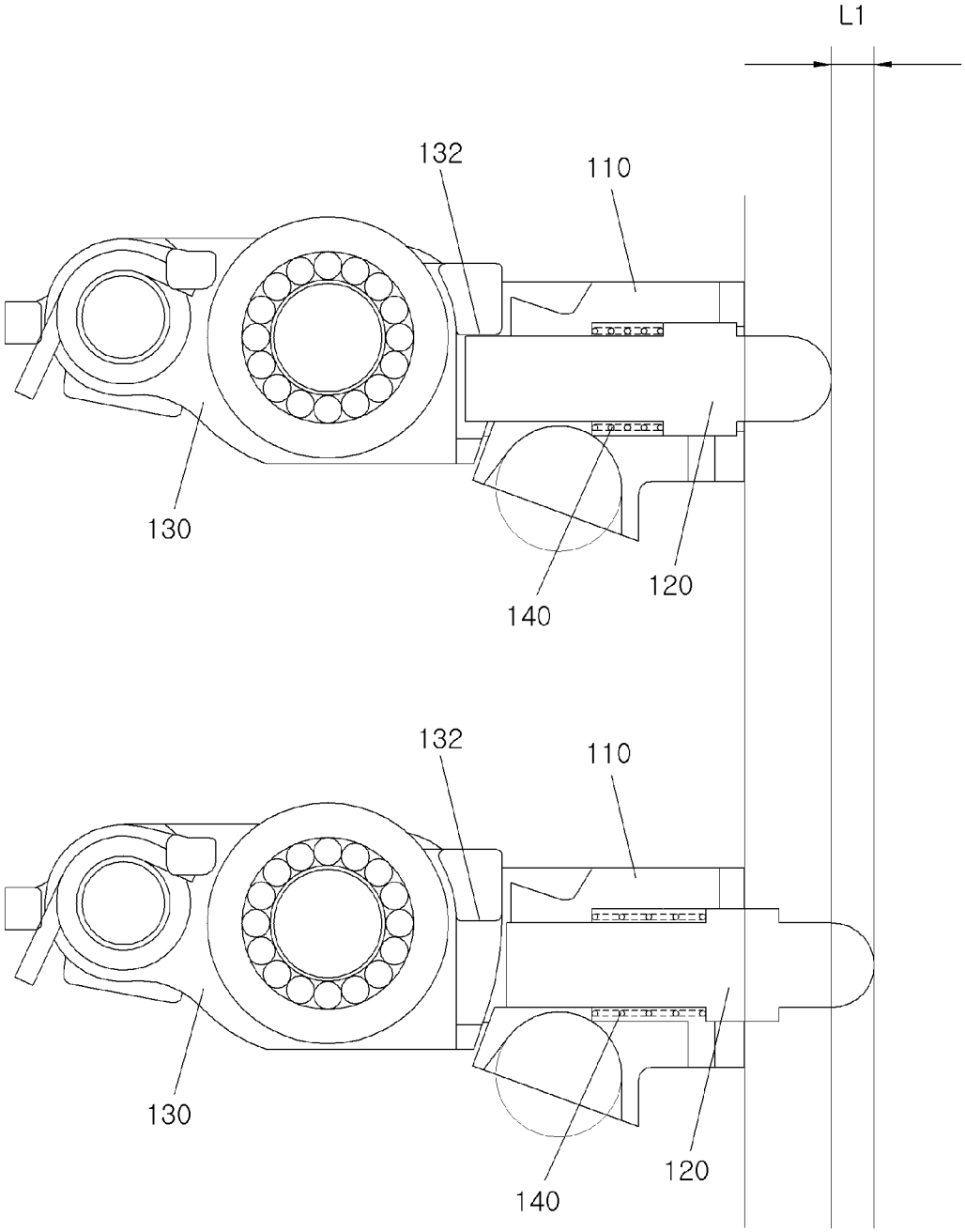
FIG. 2 is a schematic section diagram of a variable valve mechanism according to an embodiment of the present disclosure.

FIG. 1 is a schematic plane diagram of a variable valve mechanism according to an embodiment of the present disclosure and FIG. 2 is a schematic section diagram of a variable valve mechanism according to an embodiment of the present disclosure.

FIGS. 1 and 2 show the plane and section views when the variable valve mechanism 100 according to an embodiment of the present disclosure is in latched and unlatched states, respectively. The electro-mechanical variable valve mechanism 100 comprises a variable valve mechanism body 110. A latching pin 120 is arranged in front of the variable valve mechanism body 110 and an inner body 130 is arranged inside the variable valve mechanism body 110. The latching pin 120 reciprocates in the longitudinal direction of the variable valve mechanism body 110 and the inner body 130 to latch the variable valve mechanism body 110 and the inner body 130.

In an exemplary specific embodiment, the latching pin reciprocating part 112 for allowing the latching pin 120 to reciprocate is formed in front of the variable valve mechanism body 110 and a latching part 132 at which the latching pin 120 is to be latched is formed in front of the inner body 130.

Further, a latching spring 140 for imparting spring force to the latching pin 120 is provided in front of the variable valve mechanism body 110. In other words, the latching pin 120 is configured to be inserted into the latching spring 140. Further, it is preferable that an end of the latching pin 120 at which the latching pin is latched to the inner body 130 is of a plane and a portion of the latching pin at which the latching pin 120 contacts the control unit for the variable valve mechanism is of a round shape.

According to this configuration, length of the latching pin 120 is larger than length of the latching pin reciprocating part 112 of the variable valve mechanism body 110 wherein a latching length formed by both the latching pin 120 and the latching part 132 is L1.

Figure 3:
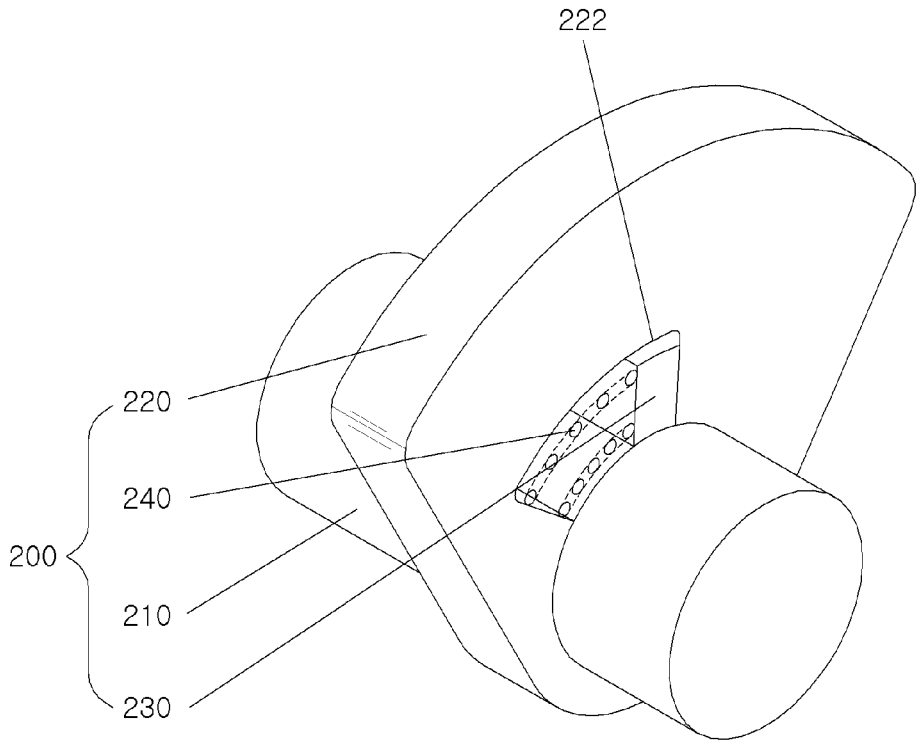
FIG. 3 is a schematic perspective diagram of a control unit for a variable valve mechanism according to an embodiment of the present disclosure.

FIG. 3 is a schematic perspective diagram of a control unit for a variable valve mechanism according to an embodiment of the present disclosure.

Referring to FIG. 3, a control unit 200 for a variable valve mechanism according to an embodiment of the present disclosure comprises a control camshaft 210, a control cam 220 through which the control camshaft 210 passes, a control camshaft connection pin 230 arranged inside the control cam 220 and connected to the control camshaft 210, and a control spring 240 to be pressed to the control camshaft connection pin 230. A driving force generating unit of the control unit 200 for a variable valve mechanism is preferably an electric motor.

In an exemplary specific embodiment, the control cam 220 is of a fan shape and the control cam 220 is configured such that a control cam hole 222 for allowing the control camshaft connection pin 230 and the control spring 240 to be arranged therein is formed to pierce the control cam.

Figure 4:
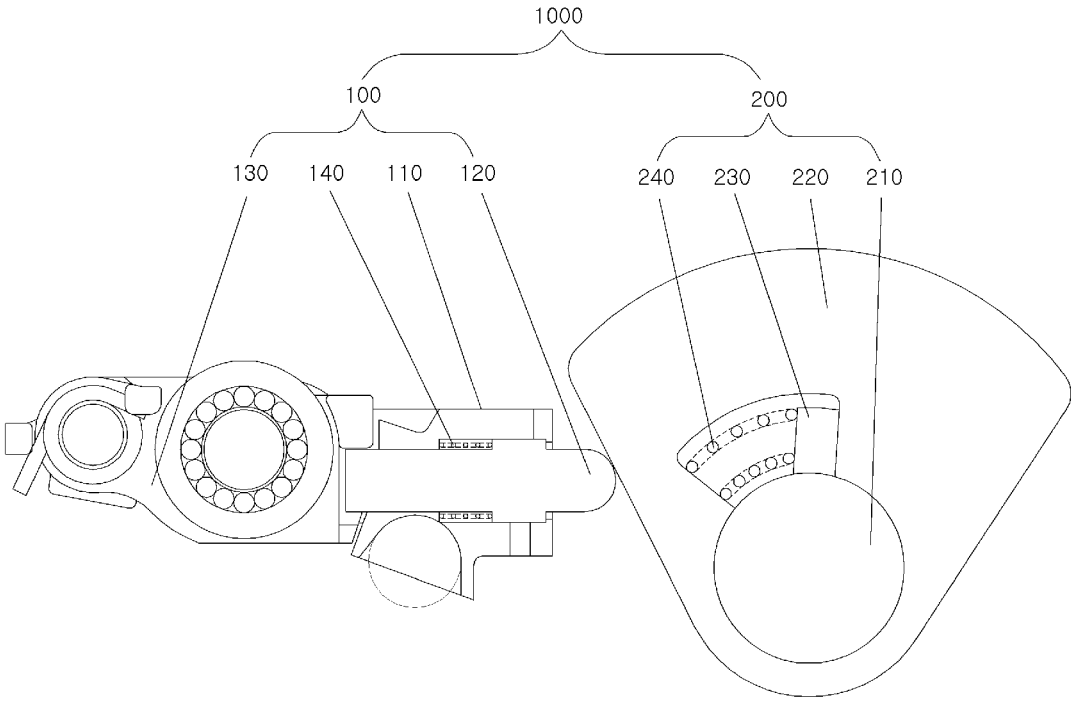
FIG. 4 is a schematic diagram of an electro-mechanical variable valve system according to an embodiment of the present disclosure.
Figure 5:
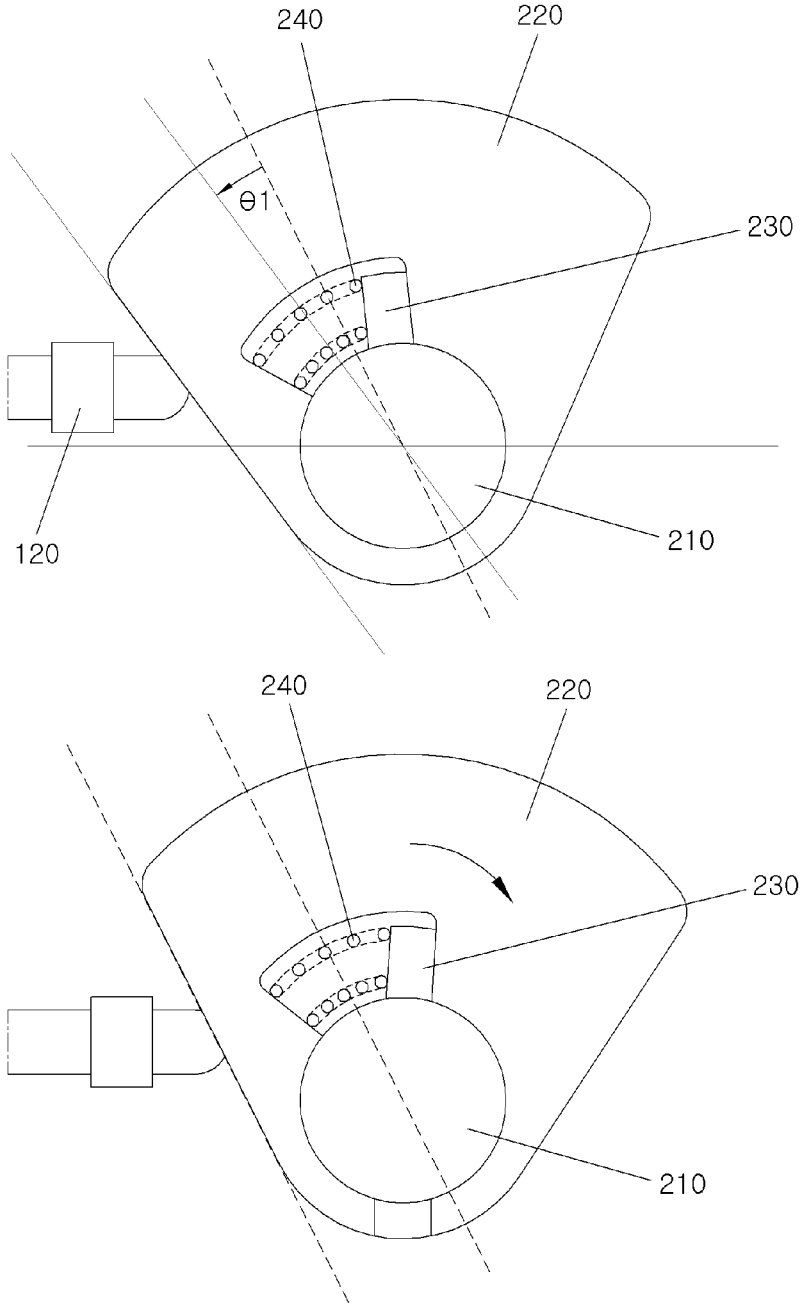
FIG. 5 is a schematic diagram illustrating a latching angle of a control unit for a variable valve mechanism according to an embodiment of the present disclosure.

FIG. 4 is a schematic diagram of an electro-mechanical variable valve system according to an embodiment of the present disclosure and FIG. 5 is a schematic diagram illustrating a latching angle of a control unit for a variable valve mechanism according to an embodiment of the present disclosure.

Referring to FIGS. 4 and 5 together with FIGS. 1 to 3, an electro-mechanical variable valve system 1000 according to an embodiment of the present disclosure comprises an electro-mechanical variable valve mechanism 100 including a variable valve mechanism body 110, a latching pin 120 arranged in front of the variable valve mechanism body 110, and an inner body 130 arranged inside the variable valve mechanism body 110. A control unit 200 for the variable valve mechanism includes a control camshaft 210, a control cam 220 through which the control camshaft 210 passes, a control camshaft connection pin 230 arranged inside the control cam 220 and connected to the control camshaft 210, and a control spring 240 to be pressed to the control camshaft connection pin 230. The control unit 200 for the variable valve mechanism reciprocates the latching pin 120 of the electro-mechanical variable valve mechanism 100 to latch or unlatch the variable valve mechanism body 110 and the inner body 130.

According to this embodiment of the present disclosure, the control unit 200 for the variable valve mechanism presses the latching pin 120 to latch the variable valve mechanism body 110 and the inner body 130 of the electro-mechanical variable valve mechanism 100.

Further, the control unit 200 for the variable valve mechanism releases pressure to the latching pin 120 to unlatch the variable valve mechanism body 110 and the inner body.

In this case, the angle at which the control unit 200 for the variable valve mechanism rotates to latch the latching pin 120 is $\theta_1$ with respect to the control camshaft 210.

Figure 6:
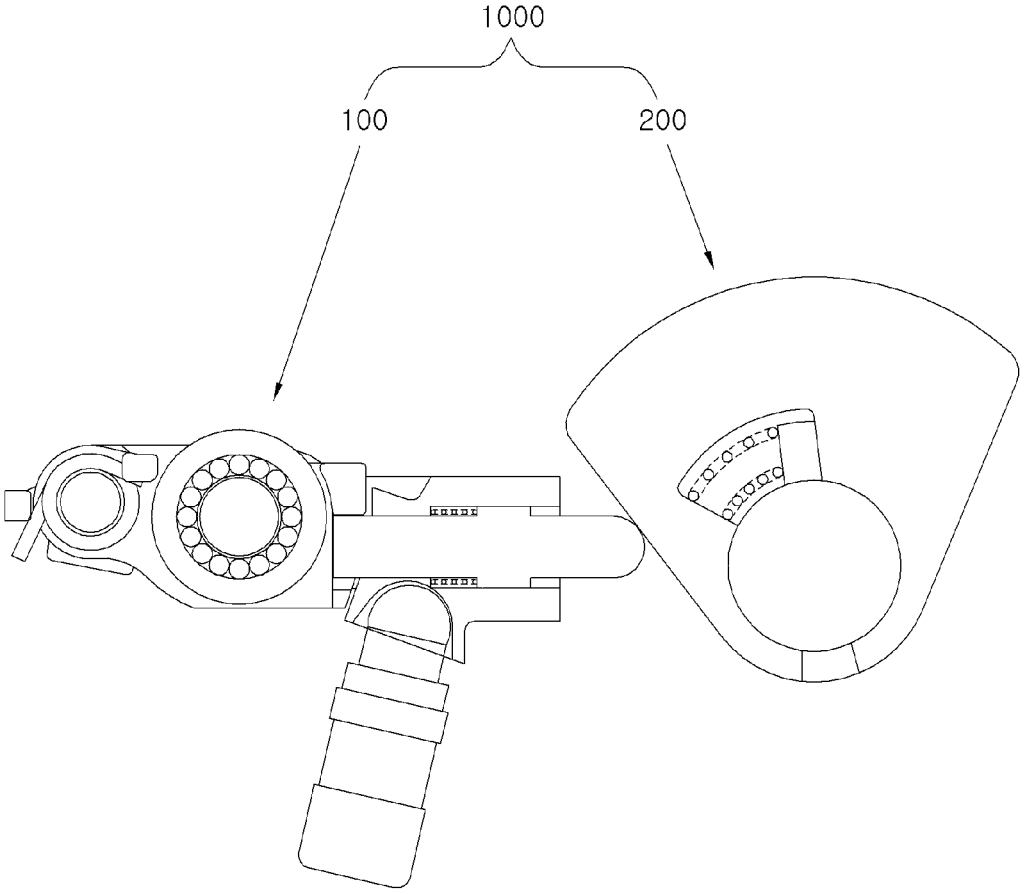
FIG. 6 is a schematic diagram illustrating a latched state of an electro-mechanical variable valve system according to an embodiment of the present disclosure.
Figure 7:
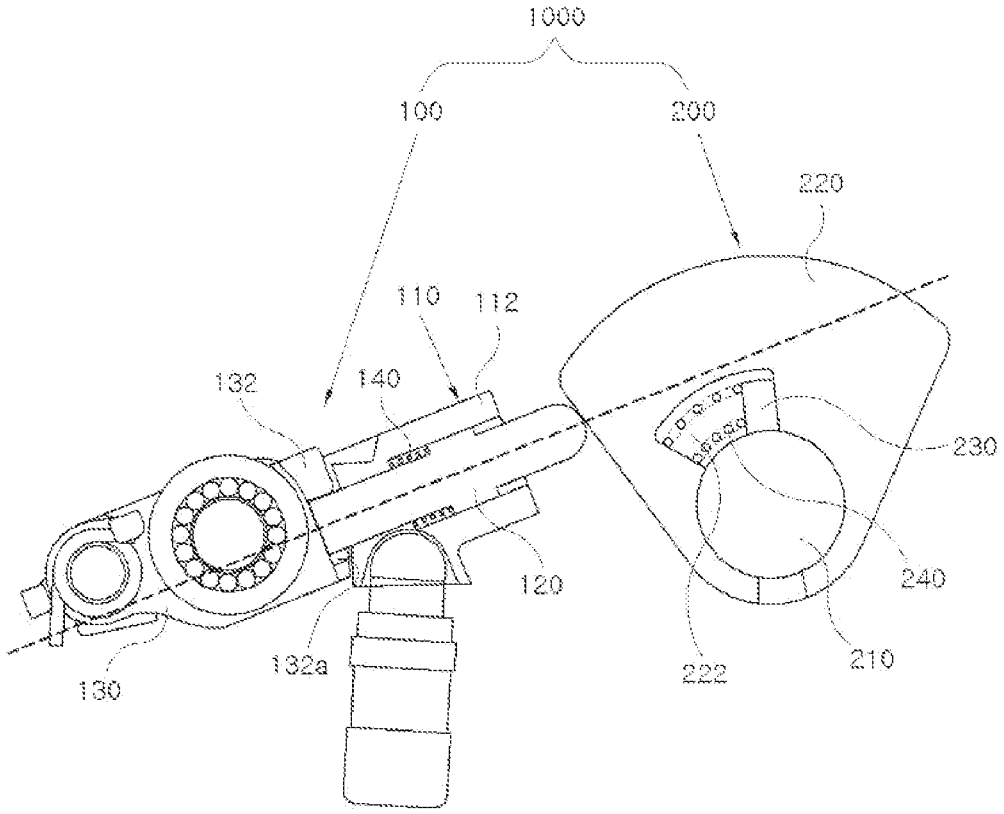
FIG. 7 is a schematic diagram illustrating another latched state of an electro-mechanical variable valve system according to an embodiment of the present disclosure.
Figure 8:
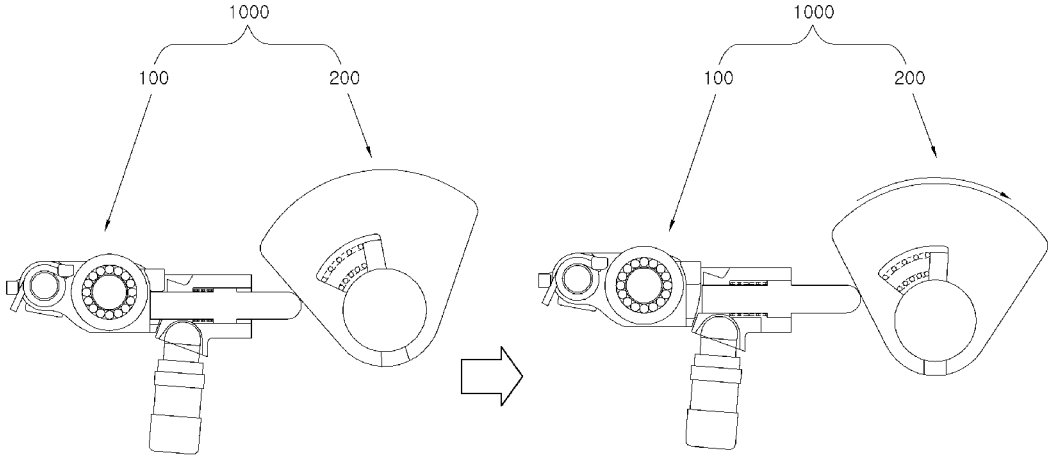
FIG. 8 is a schematic diagram illustrating an unlatched state of an electro-mechanical variable valve system according to an embodiment of the present disclosure.
Figure 9:
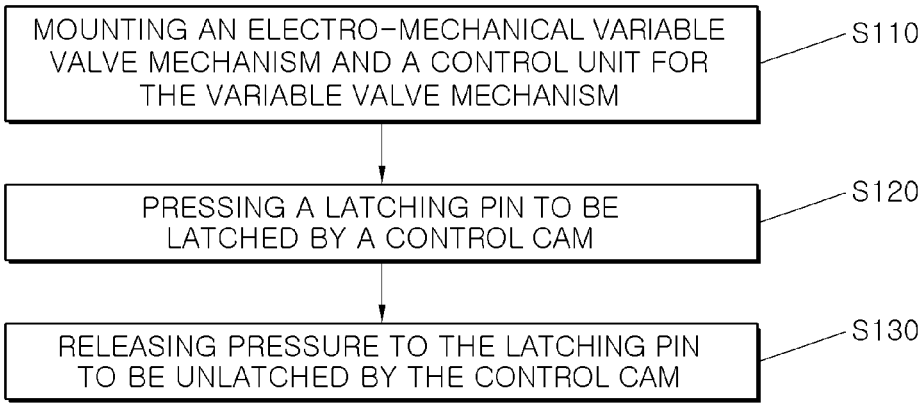
FIG. 9 is a flow chart illustrating a control method of an electro-mechanical variable valve system according to an embodiment of the present disclosure.

FIG. 6 is a schematic diagram illustrating a latched state of an electro-mechanical variable valve system according to an embodiment of the present disclosure will FIG. 7 is a schematic diagram illustrating another latched state of an electro-mechanical variable valve system according to an embodiment of the present disclosure, FIG. 8 is a schematic diagram illustrating an unlatched state of an electro-mechanical variable valve system according to an embodiment of the present disclosure, and FIG. 9 is a flow chart illustrating a control method of an electro-mechanical variable valve system according to an embodiment of the present disclosure.

Referring to FIGS. 6 to 9 together with FIGS. 1 to 5, an operating relationship and a control method according to an embodiment of the present disclosure will be described below. A control method of an electro-mechanical variable valve system 1000 comprises a step S110 of mounting an electro-mechanical variable valve mechanism 100 and a control unit 200 for the variable valve mechanism and a step S120 of pressing a latching pin 120 of the electro-mechanical variable valve mechanism 100 by a control cam 220 of the control unit 200 for the variable valve mechanism. After latching by the latching pin 120 is performed, the control cam 220 of the control unit 200 for the variable valve mechanism releases pressure to the latching pin 120 of the electro-mechanical variable valve mechanism 100 in step S130.

In an exemplary specific embodiment, in the step of pressing the electro-mechanical variable valve mechanism 100 by the control cam 220 of the control unit 200 for the variable valve mechanism, the latching pin 120 is converted from an unlatched state to a latched state.

According to this embodiment of the present disclosure, when the latching pin 120 is in the process of being converted from the latched state to the unlatched state, the latching pin is latched at the time when the control cam 220 is in a base circle, that is, in the central portion and a radial portion of the control cam 220 and the center of a latching hole 132*a* of the inner body 130 at the latching part 132 is concentric with the center of the latching pin 120.

Further, when the latching pin 120 is in the process of being converted from the unlatched state to the latched state, the control spring 240 is compressed at the time when the control cam 220 is lifted in a lifting section, that is, in an are portion of a fan shape of the control cam 220 and then the latching pin is latched at the time when the control cam 220 is in the base circle section.

On the other hand, in the step in which the control cam 220 of the control unit 200 for the variable valve mechanism releases pressure to the electro-mechanical variable valve mechanism 100, the latching pin 120 is converted from the latched state to the unlatched state.

At this time, the latching pin is unlatched at the time when the control cam 220 is in the base circle and the center of the latching hole 132*a* of the inner body 130 at the latching part 132 is concentric with the center of the latching pin 120.

Further, when the control cam 220 comes in the base circle section from the lifting section, the inner body 130 releases the latching pin 120 so that the latching pin is unlatched by the latching spring 140.

According to an embodiment of the present disclosure, the electro-mechanical variable valve mechanism, the control unit for the variable valve mechanism, the electro-mechanical variable valve system and the control method thereof provide advantageous effects in that it is possible to control the variable valve mechanism electromechanically so that it is possible to control the variable valve mechanism irrespective of the state of engine oil; it is possible to lower production cost because they are composed of fewer components; and it is possible to improve fuel efficiency and torque because they make it possible to perform optimal control of valves.

It will be understood by those skilled in the art that the present disclosure may be embodied in other specific forms without departing from the spirit or essential characteristics thereof. Therefore, it should be understood that the embodiments as described above are merely selected among various possible examples and provided as the most preferred embodiments of the present disclosure in order for those skilled in the art to understand the present disclosure and therefore the technical spirit of the present disclosure is not necessarily restricted or limited only by the embodiments provided and that various changes, additions and modifications may be made without departing from the spirit of the present disclosure and other embodiments equivalent thereto are possible. The scope of the present disclosure is defined by the appended claims rather than by the foregoing description and all changes or modifications derived from the meaning and scope of the claims and the equivalents thereof should be construed to be covered by the scope of the present disclosure. The terms and words used in the specification and claims are defined on the basis of the principle that the inventor can define the concept of a term appropriately in order to describe his/her own disclosure in the best way and should not be construed as only their ordinary or dictionary sense. In addition, it is natural that the order of configurations described in the foregoing description is not necessarily required to be performed in a time-series order and that although the order of carrying out each of the configurations or steps is changed, if this change fulfills the gist of the present disclosure, it will fall within the scope of the present disclosure.

What is claimed is:

1. An electro-mechanical variable valve system comprising:

an electro-mechanical variable valve mechanism comprising:

a variable valve mechanism body;

a latching pin arranged in front of the variable valve mechanism body; and an inner body arranged inside the variable valve mechanism body and having a latching hole configured to latch or unlatch the latching pin; and a control unit for the electro-mechanical variable valve mechanism, the control unit comprising:

a control camshaft;

a fan shaped control cam through which the control camshaft can pass, the control cam including a control cam hole comprising an arch shaped opening having a first arc and a second arc radially spaced from the first arc;

a control camshaft connection pin arranged inside the control cam and connected to the control camshaft; and a control spring to be pressed to the control camshaft connection pin, the control camshaft connection pin and the control spring being arranged within the arch shaped opening of the control cam hole;

wherein the control unit for the electro-mechanical variable valve mechanism causes the latching pin of the electro-mechanical variable valve mechanism to reciprocate in order to latch or unlatch the variable valve mechanism body and the inner body.

2. The electro-mechanical variable valve system according to claim 1, wherein the control unit for the electro-mechanical variable valve mechanism causes the latching pin to be pressed to latch the variable valve mechanism body and the inner body of the electro-mechanical variable valve mechanism.

3. The electro-mechanical variable valve system according to claim 1, wherein the control unit for the electro-mechanical variable valve mechanism causes pressure to the latching pin to be released to unlatch the variable valve mechanism body and the inner body.

4. The electro-mechanical variable valve system according to claim 1, further comprising a latching pin reciprocating part configured to allow the latching pin to reciprocate, the latching pin reciprocating part being formed in front of the variable valve mechanism body.

5. The electro-mechanical variable valve system according to claim 4, wherein a length of the latching pin is larger than a length of the latching pin reciprocating part.

6. The electro-mechanical variable valve system according to claim 1, further comprising a latching spring configured to impart spring force to the latching pin, the latching spring being provided in front of the variable valve mechanism body.

7. The electro-mechanical variable valve system according to claim 1, wherein a portion of the latching pin in contact with the control unit has a round shape.

8. A control method of an electro-mechanical variable valve system, the method comprising:

providing an electro-mechanical variable valve mechanism comprising:

a variable valve mechanism body;

a latching pin arranged in front of the variable valve mechanism body; and an inner body arranged inside the variable valve mechanism body and having a latching hole to latch or unlatch the latching pin;

providing a control unit comprising:

a control camshaft;

a fan shaped control cam through which the control camshaft can pass, the control cam including a control cam hole comprising an arch shaped opening having a first arc and a second arc radially spaced from the first arc;

a control camshaft connection pin arranged inside the control cam and connected to the control camshaft; and a control spring to be pressed to the control camshaft connection pin, the control camshaft connection pin and the control spring being arranged within the arch shaped opening of the control cam hole, wherein the control unit for the electro-mechanical variable valve mechanism causes the latching pin of the electro-mechanical variable valve mechanism to reciprocate in order to latch or unlatch the variable valve mechanism body and the inner body, pressing the latching pin of the electro-mechanical variable valve mechanism by the control cam of the control unit for the electro-mechanical variable valve mechanism; and releasing pressure to the latching pin of the electro-mechanical variable valve mechanism by the control cam of the control unit for the electro-mechanical variable valve mechanism.

9. The method according to claim 8, wherein the latching pin is converted from an unlatched state to a latched state upon pressing the electro-mechanical variable valve mechanism by the control cam of the control unit for the electro-mechanical variable valve mechanism.

10. The method according to claim 9, wherein upon being converted from the unlatched state to the latched state, the latching pin is latched at a time when the control cam is in a base circle and a center of the latching hole of the inner body is concentric with a center of the latching pin.

11. The method according to claim 9, wherein upon being converted from the unlatched state to the latched state, the control spring is compressed at a time when the control cam is lifted, and the latching pin is latched at a time when the control cam is in a base circle section.

12. The method according to claim 9, wherein the latching pin is converted from the latched state to the unlatched state upon releasing pressure to the electro-mechanical variable valve mechanism by the control cam of the control unit for the electro-mechanical variable valve mechanism.

13. The method according to claim 8, wherein the latching pin is converted from a latched state to an unlatched state upon releasing pressure to the electro-mechanical variable valve mechanism by the control cam of the control unit for the electro-mechanical variable valve mechanism.

14. The method according to claim 13, wherein the latching pin is unlatched at a time when the control cam is in a base circle and a center of the latching hole of the inner body of the electro-mechanical variable valve mechanism is concentric with a center of the latching pin.

15. The method according to claim 13, wherein, when the control cam comes in a base circle section from a lifting section, the inner body of the electro-mechanical variable valve mechanism releases pressure to the latching pin so that the latching pin is unlatched by the latching spring.

16. An electro-mechanical variable valve system comprising:

an electro-mechanical variable valve mechanism comprising:

a variable valve mechanism body;

a latching pin arranged in front of the variable valve mechanism body; and an inner body arranged inside the variable valve mechanism body and having a latching hole configured to latch or unlatch the latching pin; and a control unit for the electro-mechanical variable valve mechanism, the control unit comprising:

a control camshaft;

a fan shaped control cam through which the control camshaft can pass, the control cam including a control cam hole comprising an arch shaped opening having a first arc and a second arc radially spaced from the first arc;

a control camshaft connection pin arranged inside the control cam and connected to the control camshaft; and a control spring to be pressed to the control camshaft connection pin, the control camshaft connection pin and the control spring being arranged within the arch shaped opening of the control cam hole;

wherein the control unit for the electro-mechanical variable valve mechanism causes the latching pin of the electro-mechanical variable valve mechanism to reciprocate in order to latch or unlatch the variable valve mechanism body and the inner body; and wherein the latching pin reciprocates in a longitudinal direction of the variable valve mechanism body and the inner body to latch the variable valve mechanism body and the inner body.

17. The electro-mechanical variable valve system according to claim 16, further comprising a latching pin reciprocating part configured to allow the latching pin to reciprocate, the latching pin reciprocating part being formed in front of the variable valve mechanism body.

18. The electro-mechanical variable valve system according to claim 17, wherein a length of the latching pin is larger than a length of the latching pin reciprocating part.

19. The electro-mechanical variable valve system according to claim 16, further comprising a latching spring configured to impart spring force to the latching pin, the latching spring being provided in front of the variable valve mechanism body.

20. The electro-mechanical variable valve system according to claim 16, wherein a portion of the latching pin in contact with the control unit has a round shape.

* * * * *